United States Patent [19]

Wolf

[11] Patent Number: 4,635,431

[45] Date of Patent: Jan. 13, 1987

[54] MACHINE FOR PRODUCING TWISTED FILAMENTS

[75] Inventor: Horst Wolf, Albershausen, Fed. Rep. of Germany

[73] Assignee: Zinser Textilmaschinen GmbH, Ebersbach/Fils, Fed. Rep. of Germany

[21] Appl. No.: 662,288

[22] PCT Filed: Jan. 18, 1984

[86] PCT No.: PCT/DE84/00010

§ 371 Date: Sep. 20, 1984

§ 102(e) Date: Sep. 20, 1984

[87] PCT Pub. No.: WO84/02932

PCT Pub. Date: Aug. 2, 1984

[30] Foreign Application Priority Data

Jan. 20, 1983 [DE] Fed. Rep. of Germany ..... 3301811

[51] Int. Cl.[4] ..... D01H 13/00

[52] U.S. Cl. ..... 57/105; 57/100

[58] Field of Search ..... 57/92, 93, 100, 104, 57/105; 474/134, 148; 198/813, 854, 804, 835

[56] References Cited

U.S. PATENT DOCUMENTS

| | | | |
|---|---|---|---|
| 1,442,037 | 1/1923 | Bamford | 57/105 |
| 1,497,619 | 6/1924 | Waechter et al. | 198/813 |
| 1,558,952 | 10/1925 | Van Inwagen | 198/854 X |
| 1,804,091 | 5/1931 | Durand | 57/105 X |
| 1,983,038 | 12/1934 | Lenk | 57/105 |
| 2,791,318 | 5/1957 | Johnson et al. | 198/813 X |
| 3,352,095 | 11/1967 | Heumann | 57/105 |
| 3,918,574 | 11/1975 | Allison | 198/835 X |
| 4,161,862 | 7/1979 | Hartmannsgruber et al. | 57/92 |

FOREIGN PATENT DOCUMENTS

| | | | |
|---|---|---|---|
| 1056050 | 4/1959 | Fed. Rep. of Germany | 198/854 |
| 2108335 | 9/1972 | Fed. Rep. of Germany . | |
| 2641434 | 4/1979 | Fed. Rep. of Germany . | |
| 263107 | 3/1929 | Italy | 57/105 |
| 116782 | 9/1926 | Switzerland | 57/104 |
| 446142 | 3/1968 | Switzerland | 57/105 |
| 2044302 | 10/1980 | United Kingdom | 57/100 |
| 996542 | 2/1983 | U.S.S.R. | 57/264 |

*Primary Examiner*—Stuart S. Levy
*Assistant Examiner*—Joseph J. Hail, III
*Attorney, Agent, or Firm*—Karl F. Ross; Herbert Dubno

[57] ABSTRACT

On a ring spinning or twisting machine which comprises a row of spindles on each of the two longitudinal sides of the machine, these spindles being drivable in common by a single tangential belt, at least one driven tangential belt drive roller is mounted in each longitudinal end region of the machine and at least at one other place therebetween. The other place is at the region of the substantially straight path of the tangential belt and has no looping, or only slight looping. The energy transmission is effected by pressing or gently looping the tangential belt against a friction drive roller by means of a pressing roller. The pressing roller may consist of the whorl of an operating unit of the machine. A back pressure roller may be associated therewith in order to ease its mounting.

8 Claims, 7 Drawing Figures

MACHINE FOR PRODUCING TWISTED FILAMENTS

CROSS REFERENCE TO RELATED APPLICATIONS

This application is a national phase application corresponding to PCT/DE 84/00010 filed Jan. 18, 1984 and based upon German application No. P 33 01 811.1 filed Jan. 20, 1983.

FIELD OF THE INVENTION

The invention relates to a machine for producing twisted filaments.

BACKGROUND OF THE INVENTION

A machine for producing twisted filaments may be constructed, for example, as a ring spinning frame, a ring twisting machine, an open-end rotor spinning machine, an open end friction spinning machine or the like. The common to these types of machines is that they produce twisted filaments. Suitable starting materials for twisted filaments of this kind include, for example, spun fibers and continuous filaments. The operating units of machines of this kind, such as the spindles, rotors, separating rollers and the like are driven with whorls by means of tangential belts. As a result of the looping of the driven whorls, however slight, and their pressing rollers caused by the tangential belt, there is considerable energy consumption and wear on the belt over the large number of operating units. This energy consumption and wear on the belt increases as the number of operating units increases overall, but also for each operating unit, since the tangential belt must be made thicker and/or wider for a larger number of operating units in order to transmit the power required.

In order to reduce the energy losses and cut down the wear on the tangential belt it has already been proposed to provide a deflecting pulley driven by the tangential belt and having the tangential belt looping round it not only at one guide point at the end but at both guide points, one at each end (DE-OS No. 21 08 335).

However, since machines of this type cannot always have two deflecting pulleys for the tangential belt even with larger and larger numbers of operating units, the possibility of avoiding energy consumption and wear by this method is very limited. Furthermore, since it has been found that the energy losses caused by the operation of the tangential belt, per operating unit, are at a minimum with a drive arrangement designed for about 250 operating units, but it is industrially desirable and useful to fit a machine for producing twisted filaments with more than 250 and possibly up to 1,000 operating units, an objective of the invention is to introduce possible ways of introducing additional energy into a single tangential belt of the type described.

OBJECT OF THE INVENTION

It is, therefore, an object of the invention to provide a low-waste, inexpensive tangential belt drive for machines for producing twisted filaments comprising a large number of operating units without having to increase the spacing between the operating units at individual points, thereby taking up more space, and without the need for any additional major looping.

SUMMARY OF THE INVENTION

According to the invention, this object is achieved by pressing the tangential belt against a drive friction roller with no or only little looping, i.e. with no substantial looping not only at its guide points at the two longitudinal end regions of the machine but additionally at at least one other point along its substantially straight path, by means of a pressing roller or a whorl, and driving the belt by means of this drive friction roller.

In this way, at least one additional drive point is provided which does not stress the tangential belt by considerable looping. Under certain conditions, the additional drive point makes it possible to reduce the stress on the tangential belt, as well as reducing the energy losses. The additional drive point is located, for example, at the center of the length of the belt. In a two-end machine, at least one driven friction roller according to the invention is advantageously provided at each end of the machine.

According to a further embodiment of the invention, the pressing roller is formed by the whirl of one of the operating units. The spacing between adjacent operating units does not need to be enlarged. In order to be able to retain the mounting of the whorl and not have to allow any special constructions, the whorl is advantageously associated with a counter roller which relieves its mounting of the contact pressure. It is generally simpler to provide a counter roller than to alter the conventional mounting of the whirl of an operating unit.

If a drive friction roller and the associated pressing roller are mounted so that a plane containing the rotation axis of the drive friction roller and of the pressing roller is perpendicular to the longitudinal dimension of the tangential belt, no looping angle occurs and in practice no fulling losses can occur. However, it has been found that even when a drive friction roller and the associated pressing roller are mounted so that a plane containing the rotation axes of the drive friction roller and pressing roller forms a small angle of, for example, not more than 10° with the longitudinal dimension of the tangential belt and hence a looping angle of this magnitude is produced, the fulling losses are negligible, but the contact pressure between the rollers can be reduced substantially with the same efficiency of energy transmission. In many cases, it is advantageous to protect the mountings of the rollers substantially from the influence of the point of action of the tangential belt by having the sum of the radii of the drive friction roller, the pressing roller and the thickness of the tangential belt—using the above mentioned small looping angle—greater than the spacing of the rotation axes of the drive friction roller and the pressing roller from one another.

In order to equalize the transmission of energy to the tangential belt in relation to its longitudinal dimension, the drive at the two longitudinal end regions of the machine is effected by means of two tangential belt deflecting pulleys in each case, while for each longitudinal end region of the machine only one tangential belt deflecting pulley is drivable by an electric motor. Advantageously, the tangential belt deflecting pulley which will be driven by the electric motor in question is the one onto which the tangential belt runs first from the adjacent row of spindles. Advangageously, each tangential belt deflecting pulley deflects the tangential belt through 90°.

As a result of the paired arrangement of the deflecting pulleys in the two longitudinal end regions of the machine, the diameters of these deflecting pulleys can be freely selected and can thus be so small that, starting from motors with the usual number of pulleys and hence the usual speeds, the required tangential belt speed can be achieved even when, according to the invention, the friction pressing rollers may be mounted directly on the rotor shafts of the associated electric motor without the interposition of an energy-saving transmission gear. This also has the advantage that identical motors may be used both on the drive rollers at the longitudinal end regions of the machine and also on those drive rollers along the straight course of the tangential belt. This enables the motors to be supplied from a single supply source which may possibly vary the motor speed by altering its parameters of voltage, current and/or frequency.

As a further feature of this invention, it is proposed that at least one of the electric motors can be selectively switched off so that the tangential belt is then drivable only by the other electric motor or motors. In this way, economical partial-load operation of the machine is possible if the machine is operating, for example, under certain operating conditions, at a speed which is less than its maximum speed for which the performance of the drive motors must be designed. It may also be advantageous to switch off individual motors to give an operating speed requiring less long-term drive power after full operation of the machine requiring increased drive power.

Preferably, the electric motors driving the friction drive rollers in question serve only to drive the tangential belt and have no other purposes. In this case, other essential operating components of the machine such as the drawing mechanisms, ring rails or the like may be driven by at least one other electric motor.

Then, preferably, one of the electric motors involved in driving the tangential belt may simultaneously serve as a pilot motor for controlling or regulating the speed of at least one of the other electric motors.

It is clear that as a result of the reduction in the stress on the tangential belt achieved by the measures according to the invention the expansion and wear of the belt are also reduced and it is possible to use thinner and/or narrower belts, which give a lower energy loss as a result of reduced fulling.

BRIEF DESCRIPTION OF THE DRAWING

The drawing show embodiments by way of example of the invention. These embodiments are intended to illustrate the invention and enable it to be described in greater detail. In the drawing.

SPECIFIC DESCRIPTION

Figure 1:
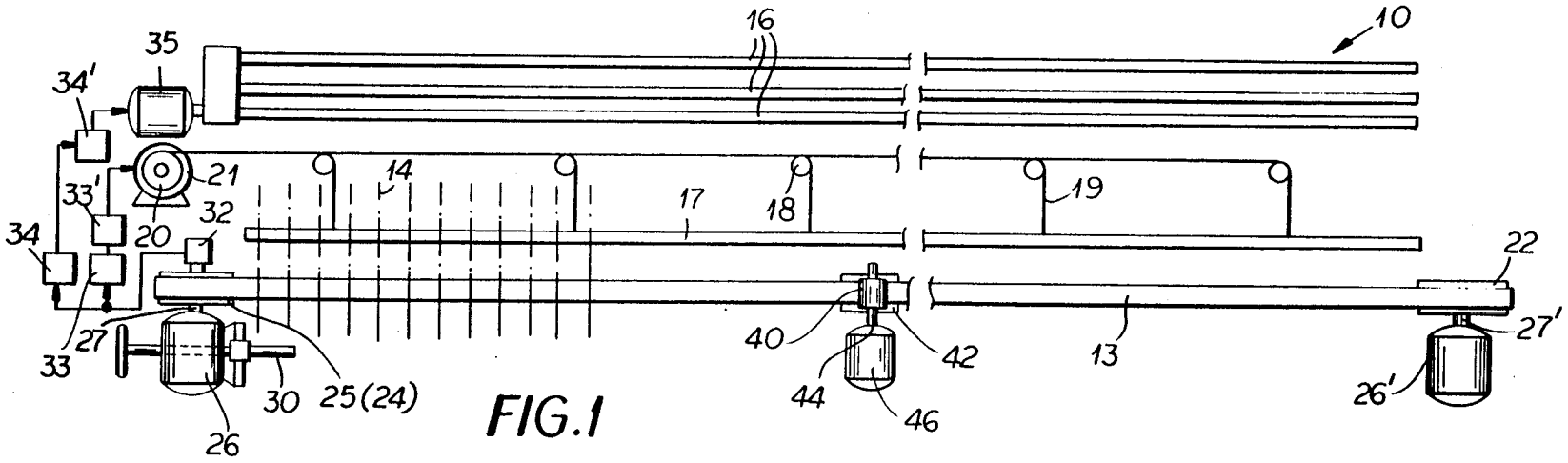
FIG. 1 shows a partial cut-away front view of a ring spinning frame in diagrammatic view showing only some operating components.
Figure 2:
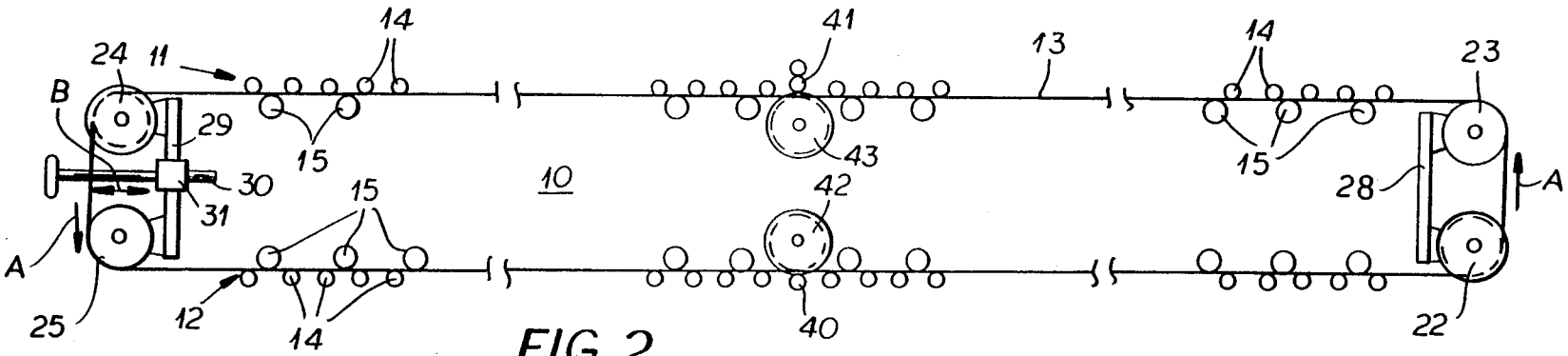
FIG. 2 shows a cut-away plan view of the tangential belt drive of the machine as shown in FIG. 1 in diagrammatic view, showing only some whorls of the driven spindle.
Figure 3:
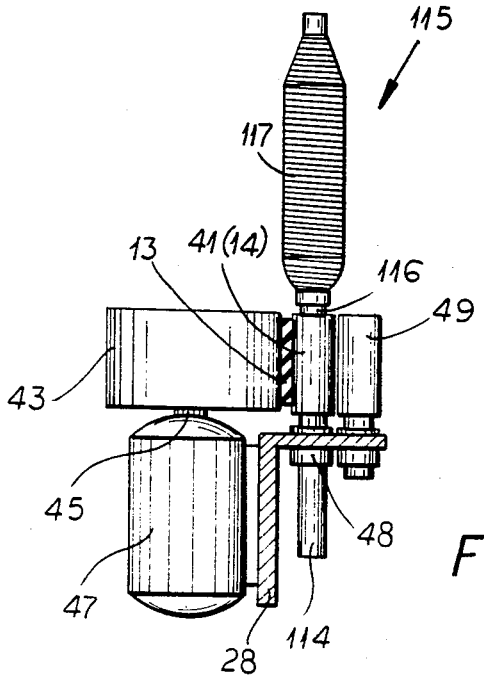
FIG. 3 shows a partial diagrammatic view of a side elevation of an operating unit on which is mounted a drive friction roller.

The machine 10 for producing twisted threads, which is in the form of a ring spinning frame and is shown in cut-away partial view in FIGS. 1 and 2, comprises at each longitudinal side of the machine an uninterrupted row 11, 12 of whirls 14, of which only a few are shown, which are driven by a single tangential belt 13 common to them all. The whorls 14 belong, as shown in FIG. 3, to drive mechanisms 114 of operating units 115 which in this case take the form of spinning stations and each comprise a spindle 116 driven by the whirl 14. The spindle 116 carries the bobbin 117 onto which the twisted thread produced will be wound.

The tangential belt 13 is pressed against the whorls 14 by rotatably mounted tension rollers 15, which are not driven.

Above each of the two rows of spindles is a row of drawing mechanisms, of which FIG. 1 shows only three continuous bottom rollers 16 of the drawing mechanisms placed at the front end of the machine.

As FIG. 1 shows, there is also a ring rail 17 on each longitudinal side of the machine; this ring rail is guided in a straight line vertically and can be moved up and down by means of cables 19 running over guide rollers 18, by winding these cables 19 onto a cable drum 20 with a reversible motor 21 and then unwinding them again.

The single tangential belt 13 of this machine 10, which drives the rows of whorls 11, 12 located on each longitudinal side of the machine, is guided over a total of four deflecting pulleys 22–25 arranged in pairs at the ends of the machine. Of these, only the deflecting pulleys 22 and 24 are motor-driven. Each deflecting pulley deflects the tangential belt through about 90°. The tangential belt is driven in the direction of the arrows A. If desired, the direction of drive of the tangential belt 13 can also be reversed in order to impart an S- or Z-twist to the threads produced, as desired.

FIG. 1 shows that the deflecting pulley 24 is located on the rotor shaft 27 of an electric motor 26. The deflecting pulley 22 on the other hand is connected to the rotor shaft 27' of another electric motor 26'. The electric motors 26 and 26' may be asynchronous motors, for example.

The mounting of the deflecting pulley 23 and the electric motor 26' are disposed at the right-hand end of the machine in a stationary position on a machine frame 28, shown only partially. By contrast, the mounting of the deflecting pulley 25 and the electric motor 26 are disposed on a carriage 29. The carriage 29 is moveable in the direction of the double arrow B longitudinally of the machine in order to tension the tangential belt 13, by means of a manually or motor-driven threaded spindle 30 which engages in the thread of a nut 31 connected to the carrage.

The tangential belt 13 is also driveable in its substantially straight path at two opposing points by means of drive friction rollers 42 and 43, respectively, which press the tangential belt 13 without any looping against pressing rollers 40 and 41 respectively. The pressing rollers in question are in this case formed by the whorl 14 of respective operating unit, i.e. spinning stations. FIG. 3 shows, for example, that the pressing roller 41 co-operating with the drive friction roller 43 is identical to the whorl 14 of the drive mechanisms 114 of the operating unit 115.

FIG. 1 shows that the drive friction roller 42 is fixed on the rotor shaft 44 of an electric motor 46. FIG. 3 shows that the drive friction roller 43 is fixed on the rotor shaft of an electric motor 47. Both electric motors 46, 47 are fixed on the machine frame 28, as shown in FIG. 3 with reference to the electric motor 47.

FIG. 3 shows that the pressing roller 41 is associated with a counter roller which relieves its mounting 48 from the contact pressure of the drive friction roller 43.

Figure 4:
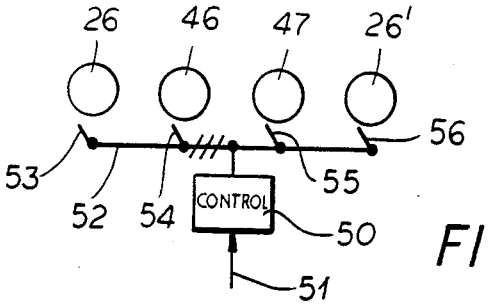
FIG. 4 shows a circuit-diagram of the electric motors serving to drive the belt.

FIG. 4 shows a possible circuit arrangement for operating the electric motors 26, 26', 46 and 47. A control instrument 50 is connected to a supply grid 51. The control instrument 50 delivers a variable-frequency voltage to the distribution lead 52. Each of the four electric motors may be individually connected to the distributor lead 52 via a switch 53–56. It is therefore possible for one of the electric motors to be switched off selectively.

The electric motors 26', 46 and 47 serve exclusively to drive the tangential belt 13. The electric motor 26 also serves essentially only to drive the tangential belt 13. The rotor of a motor which has just been switched may run idly or an overriding coupling may be provided for the drive friction roller so that only the drive friction roller runs on idly.

The electric motor 26 does not drive only the tangential belt 13 but also drives a pulse transmitter 32 which delivers pulses at a pulse frequency which is exactly proportional to the speed of the driving electric motor 26, in this case serving as a pilot motor. These pulses are control impulses for two frequency dividers 33, 34 of adjustable dividing ratios, which deliver control impulses for direct current intermediate circuit inverters 33', 34', which deliver alternating currents of variable frequency to supply the two alternating current motors 21 and 35. The alternating current motor 35 serves to drive the drawing mechanisms of the machine 10, the bottom rollers 16 of which are shown in FIG. 1. The motor 21 serves to drive the ring rail 17, as explained hereinbefore.

In the embodiment shown, the tangential belt 13 is deflected at four points. Depending on the length and design of the machine, it may be necessary or appropriate to deflect the tangential belt 13 only twice or three times at the ends instead of four times.

Figures 5, 6, 7:
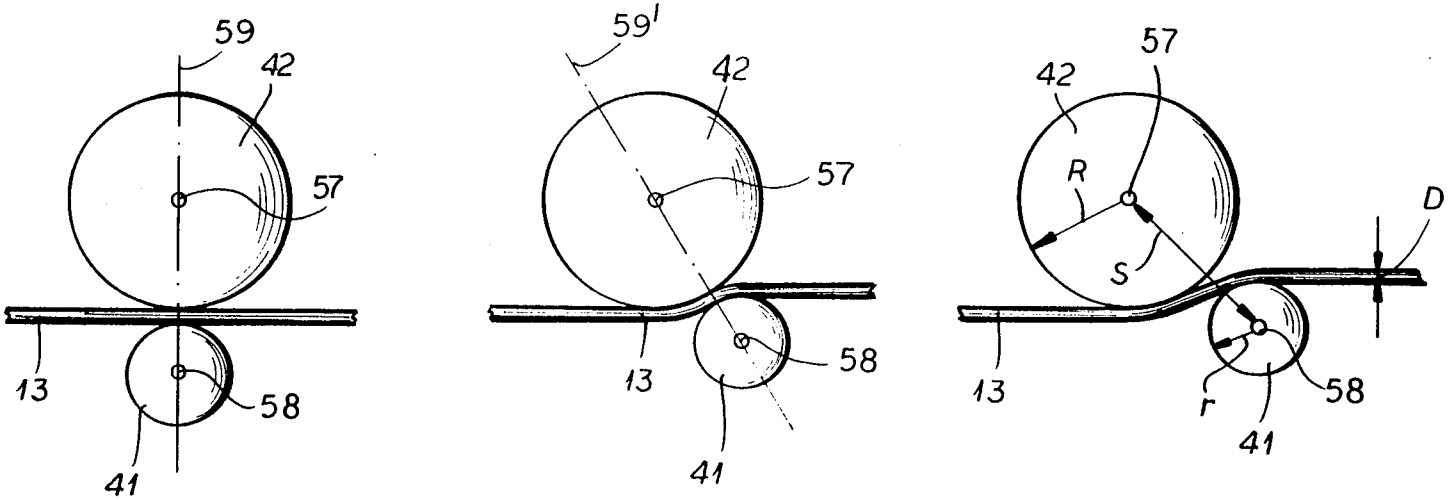
FIGS. 5 to 7 show arrangements of drive friction rollers and pressing rollers.

FIGS. 5 to 7 show alternative embodiments of the arrangement of the pressing roller or whorl 41 and the drive friction roller 42.

In the arrangement shown in FIG. 5, the plane 59 which contains the two rotation axes 57, 58 is perpendicular to the longitudinal dimension of the tangential belt 13. In the arrangement shown in FIG. 6, this plane 59' forms an angle which should be not more than 10° with the longitudinal dimension of the tangential belt.

In the arrangement shown in FIG. 7, the sum obtained from the radii R, r and the belt thickness D is mathematically less than the actual spacing s of the rotation axes 57 and 58 from each other.

What is claimed is:

1. A machine for producing a twisted yarn which comprises:

a plurality of spindles arrayed in at least one row and having respective whorls lying in a row;

an endless belt peripherally engaging the whorls of said row along a substantially linear stretch of said belt;

respective deflecting pulleys at opposite ends of said row around which said belt passes;

a respective drive motor connected with each of said deflecting pulleys for driving said belt;

a friction roller disposed intermediate said ends of said row and provided with means for causing said friction roller to bear upon said belt so that said belt engages said friction roller without looping of said belt around said friction roller; and a further motor operatively connected to said friction roller for driving same, one of said whorls being juxtaposed with said friction roller across said belt whereby said belt is pressed between said one of said whorls and said friction roller.

2. The machine defined in claim 1 wherein a counter-roller engages said one of said whorls to relieve a bearing by which said one of said whorls is journaled in said row from strain caused by the pressure of said friction roller against said belt.

3. A machine for producing a twisted yarn which comprises:

a plurality of spindles arrayed in at least one row and having respective whorls lying in a row;

an endless belt peripherally engaging the whorls of said row along a substantially linear stretch of said belt;

respective deflecting pulleys at opposite ends of said row around which said belt passes;

a respective drive motor connected with each of said deflecting pulleys for driving said belt;

a friction roller disposed intermediate said ends of said row and provided with means for causing said friction roller to bear upon said belt so that said belt engages said friction roller without looping of said belt around said friction roller; and a further motor operatively connected to said friction roller for driving same, said friction roller urging said belt against a pressing roller, said friction roller and said pressing roller being mounted so that a plane through axes of said rollers is substantially perpendicular to said linear stretch.

4. A machine for producing a twisted yarn which comprises:

a plurality of spindles arrayed in at least one row and having respective whorls lying in a row;

an endless belt peripherally engaging the whorls of said row along a substantially linear stretch of said belt;

respective deflecting pulleys at opposite ends of said row around which said belt passes;

a respective drive motor connected with each of said deflecting pulleys for driving said belt;

a friction roller disposed intermediate said ends of said row and provided with means for causing said friction roller to bear upon said belt so that said belt engages said friction roller without looping of said belt around said friction roller; and a further motor operatively connected to said friction roller for driving same, said friction roller urging said belt against a pressing roller, said friction roller and said pressing roller being mounted so that a plane through rotation axes of said rollers forms an angle no greater than 10° with said stretch of said belt.

5. The machine defined in claim 4 wherein the sum of the radii of said rollers and the thickness of said belt is less than the spacing of the axes of said rollers from one another.

6. The machine defined in claim 1 wherein at each end of said machine, a pair of pulleys are provided about which said belt is guided, said belt having two longitudinal stretches between the pairs of pulleys at opposite ends of the machine and engaging a row of whorls substantially all along each of said stretches, the drive pulleys being the pulleys of each pair onto which the belt first runs from the adjacent row of whorls.

7. The machine defined in claim 6, wherein said belt is deflected through about 90° at each of said deflecting pulleys.

8. The machine defined in claim 1, further comprising circuit means for selectively switching off one of said motors whereby said belt is driven by the remaining motors.

* * * * *